US008151850B2

(12) United States Patent
Murakami

(10) Patent No.: US 8,151,850 B2
(45) Date of Patent: Apr. 10, 2012

(54) LABEL APPLICATION DEVICE

(75) Inventor: Kenji Murakami, Tokyo (JP)

(73) Assignees: Kabushiki Kaisha Sato (JP); Kabushiki Kaisha Sato Chishiki Zaisan Kenkyusyo (JP)

( * ) Notice: Subject to any disclaimer, the term of this patent is extended or adjusted under 35 U.S.C. 154(b) by 100 days.

(21) Appl. No.: 12/681,669

(22) PCT Filed: Feb. 25, 2008

(86) PCT No.: PCT/JP2008/053192
§ 371 (c)(1),
(2), (4) Date: Apr. 5, 2010

(87) PCT Pub. No.: WO2008/136209
PCT Pub. Date: Nov. 13, 2008

(65) Prior Publication Data

US 2010/0206486 A1 Aug. 19, 2010

(30) Foreign Application Priority Data

Apr. 27, 2007 (JP) ..... 2007-119230

(51) Int. Cl.
*B32B 41/00* (2006.01)

(52) U.S. Cl. ..... 156/361; 156/378; 156/442.1; 156/443

(58) Field of Classification Search ..... 156/64, 156/204, 227, 361, 378, 442.1, 443
See application file for complete search history.

(56) References Cited

U.S. PATENT DOCUMENTS

2010/0139866 A1* 6/2010 Kirita et al. ..... 156/378

FOREIGN PATENT DOCUMENTS

| | | | |
|---|---|---|---|
| JP | 3073917 | U | 12/2000 |
| JP | 2002-182571 | A | 6/2002 |
| JP | 2007-076687 | A | 3/2007 |
| WO | WO 2007032360 | A1 * | 3/2007 |

OTHER PUBLICATIONS

English Machine Translation of JP-2007-076687, Sato Corp., Kirita Kouji, Mar. 3, 2007.*
International Search Report dated Apr. 1, 2008, issued in corresponding international application No. PCT/JP2008/053192.

* cited by examiner

*Primary Examiner* — George Koch
(74) *Attorney, Agent, or Firm* — Ostrolenk Faber LLP

(57) ABSTRACT

The object of the present disclosure is to provide a label application device which can easily perform label applying operation by protruding a portion of the label towards an article in a mountain-shape and automatically applying the label.

The label application device includes: a label holding unit comprising of an attracting board provided with a pair of divided bodies and attracting and holding a label supplied from the label supplying unit; a folding and applying unit folding and protruding a portion of a label held by the label holding unit in a mountain-shape forming a folded portion having a first side face and a second side face with an apex portion as a border therebetween, and applying an outer end portion, provided next to a folded portion via a bent portion, to an article; wherein the folding and applying unit includes: a folding unit, wherein the divided bodies and are relatively approaching and separating the other and when approaching the other, and a portion of the label is folded by pressing such that the bent portion of the label at each end surface opposing each of the divided body and forming the folded portion; and a movement control unit controlling the movement of the folding unit.

7 Claims, 14 Drawing Sheets

(a)

(b)

(c)

(d)

PRIOR ART

LABEL APPLICATION DEVICE

CROSS REFERENCE TO RELATED APPLICATIONS

The present application is a 35 U.S.C. §371 National Phase conversion of PCT/JP2008/053192, filed Feb. 25, 2008, which claims benefit of Japanese Application No. 2007-119230, filed Apr. 27, 2007, the disclosure of which is incorporated herein by reference. The PCT International Application was published in the Japanese language.

TECHNICAL FIELD

The present invention relates to a label application device for applying labels to articles, especially a label application device which folds and protrudes a portion of a label from the back side to the surface side in a mountain-shape (the back side of label urged towards the surface side of the label such that the part of the label portion protrudes to form an oblique angle) and applies the label to an article.

BACKGROUND ART

A label with a portion of the label folded and protruded from the back side to the surface side in a mountain-shape has been known in the past. Such a label, for example as shown in FIG. 14, is a rectangular-shaped label, which is formed as a folded portion 1 with a portion 2 in the middle part of the label folded and protruded from the back side to the surface side in a mountain-shape and having a first side face 4 and a second side face 5 with an apex portion 3 as a border therebetween, and having each outer end portion 7 provided next to each base end portion of the first side face 4 and the second side face 5 of the folded portions 1 via each bent portion 6. The back sides of the outer end portions 7 are coated with adhesive, and in a planar state, are temporally attached to the backing sheet not shown in the diagram. When applying the label L to an article, the label L is peeled off from the backing sheet and the folded portion 1 is formed by folding label L at the apex portion 3 and at the bent portions 6 by manual labor. Then at the outer end portions 7, the label L is applied to the article (for example, Registered Japanese Utility Model Publication No. 3073917 for reference).

SUMMARY OF INVENTION

Technical Problem

Incidentally, with such a label L, since a portion 2 of the label L is protruded to be applied to an article, the work is performed manually, thereby the applying operation becoming complicated.

The present invention has been achieved in view of this problem. Accordingly, it is an object of the present invention to provide a label application device which can protrude a portion of the label in a mountain-shape (the back side of label urged towards the surface side of the label such that the part of the label portion protrudes to form an oblique angle) and automatically applying the label towards an article, thereby facilitating applying operation.

Solution to Problem

To solve the above-mentioned problems, the label application device of the present invention includes a label application device applying a label supplied from a label supplying unit comprising: a label holding unit attracting and holding a label supplied from the label supplying unit; and a folding and applying unit folding and protruding a portion of a label held by the label holding unit from the back side of the label towards the surface side in a mountain-shape forming a folded portion having a first side face and a second side face with an apex portion as a border therebetween, and applying each outer end portion provided next to each base end portion of the first side face and the second side face of the folded portion via a bent portion to an article; wherein the label holding unit is configured with a pair of divided body which attracts and holds the label; and the label application device further comprising: the folding and applying unit, wherein the divided bodies are relatively approaching and separating the other and when approaching the other, a portion of the label is folded by pressing such that the bent portions of the label at each end surface opposing each of the divided body forming the folded portion; and a movement control unit controlling the movement of the divided bodies of the folding unit.

Accordingly, when applying labels, the pair of divided bodies of the label holding unit attracts and holds the label, and by the folding and applying unit, the pair of divided bodies approaches the other from each separation position. At this approach, the bent portions of the label are pressed by the end surfaces opposing the each divided body, and a portion of the label is folded forming the folded portion. Then, in this state, the label is applied to the article. Because of this, the applying operation can be performed extremely easily by the folding and applying unit protruding a portion of the label in a mountain-shape and automatically applying the label towards an article. Particularly, as the label application device is provided with a movement control unit which controls the movement of the divided bodies of the folding unit, at separation of the divided bodies, a portion of the label corresponding to the folded portion may be positioned between the pair of divided bodies. Therefore, at approach, the label outer end portions come in contact with the divided bodies thereby a portion of the label may be folded securely at the bent portion, reliably performing label application.

If necessary, the label application device further comprising: the movement control unit defining the position of the moving divided bodies, at a joining position where the divided bodies abut each other when the label supplied from the label supplying unit is attracted and held, from the joining position to a separation position where the divided bodies separate from the other enabling folding of the label, and from the separation position to a folded portion forming position where the divided bodies approach the other forming the folded portion. According to the setting manner of the folded portion forming position, it is possible to change the manner of label application, for example, the label application device forms a space between the first side face and the second side face of the label forming the label as it were in an inverted V-shape and applies the label, or joins the first side face and the second side face of the label and applies the label, etc.

In addition, if necessary, the separation position of the divided body is configured such that the position of which the end portion of the end surface of the divided body in contact with the label is in a corresponding position to the bent portion of the label. At approach of the divided bodies, as the end portions of the divided bodies are positioned at the bent portions of the label, it is possible to securely fold the label at the bent portions.

Further, if necessary, the label application device configures the folded portion forming position at a position separated by a predetermined interval from the joining position, and forms a space between the first side face and the second side face of the label. It is possible to apply the label providing a space between the first side face and the second side face of the label forming the label as it were in an inverted V-shape.

Furthermore, if necessary, the label application device configures the folded portion forming position at a same position as the joining position, and joins the first side face and the second side face of the label. It is possible to apply the label joining the first side face and the second side face of the label.

In addition, if necessary, it is effective to have the folding and applying unit to be provided with a fold assisting unit which assists a portion of the label to be folded from the back side towards the surface side in a mountain-shape. A portion of the label is assisted to fold towards the surface side thereby a portion of the label is securely folded in a mountain-shape.

In this case, if necessary, the hold assisting unit is provided with an air blow pipe which blows the air onto a portion of the label from the back side folding a portion of the label to the surface side with the blowing force of the air. It is possible to provide the fold assisting unit with a simple configuration.

Furthermore, if necessary, the label application device is provided such that a label supplying direction of the label supplying unit and the approaching and separating directions of the divided bodies are perpendicular to the other. In case a portion of the label is formed in a variant form, with the first side face and the second side face constricted inwardly such that a portion of the label is smaller in width, the rigidity is smaller accordingly. In this case, since the label supplying direction and the approaching and separating directions of the divided bodies are perpendicular to the other, it is possible to supply the label with the folding lines of the apex portion and the bent portions parallel to the label supplying direction, thereby preventing the label from flexing and curving at supply, enabling the label to be attracted and held securely to the label holding unit.

In addition, if necessary, the folding and applying unit includes a transfer unit which transfers the label holding unit to the two positions, the attracting and holding position where the label holding unit attracts and holds the label, and the applying position where the attracted and held label is applied to the article.

Advantageous Effects of Invention

According to the label application device of the present invention, the applying operation can be performed extremely easily by the folding and applying unit protruding a portion of the label in a mountain-shape and automatically applying the label towards an article. Particularly, as it is provided with the movement control unit controlling the movement of the divided bodies of the folding unit, at separation of the divided bodies, a portion of the label corresponding to the folded portion may be positioned between the pair of divided bodies. Therefore, at approach, the outer end portions of the label come in contact with the divided bodies and a portion of the label can be folded securely at the bent portions reliably performing label application.

BRIEF DESCRIPTION OF THE DRAWINGS

FIG. 7(*b*) is a diagram showing an example of a label used in the label application device related to the first embodiment of the present invention.

FIG. 7(*c*) is a diagram showing an example of a label used in the label application device related to the first embodiment of the present invention.

FIG. 7(*d*) is a diagram showing an example of a label used in the label application device related to the first embodiment of the present invention.

FIG. 13(*b*) is a diagram showing an example of the label used in the label application device related to the second embodiment of the present invention.

FIG. 13(*c*) is a diagram showing an example of the label used in the label application device related to the second embodiment of the present invention.

DESCRIPTION OF EMBODIMENTS

Hereinafter, a label application device according to the embodiments of the present invention is described in detail based on the attached figures.

Figure 1:
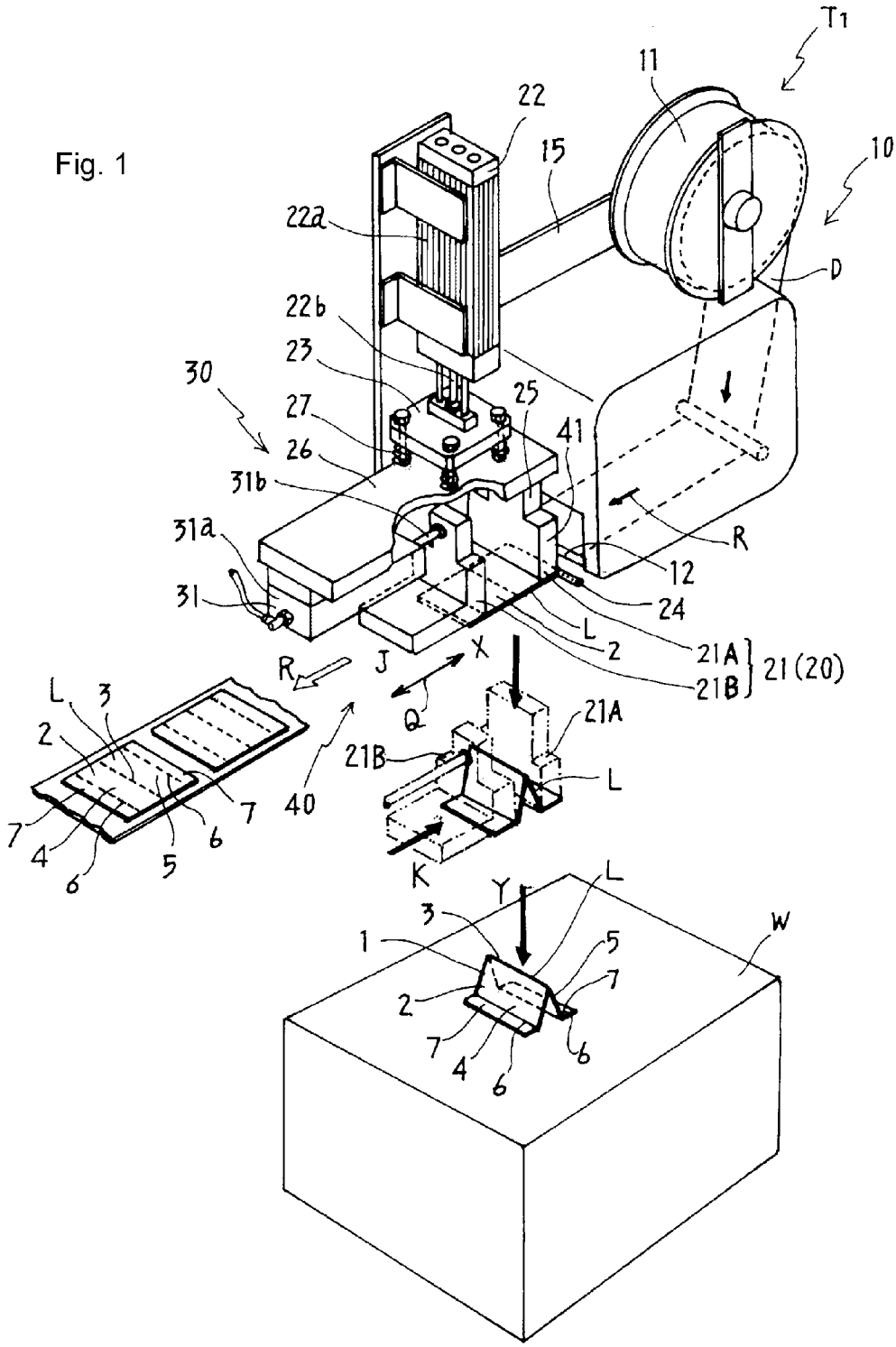
FIG. 1 is a perspective view showing the label application device of the first embodiment of the present invention.
Figure 5:
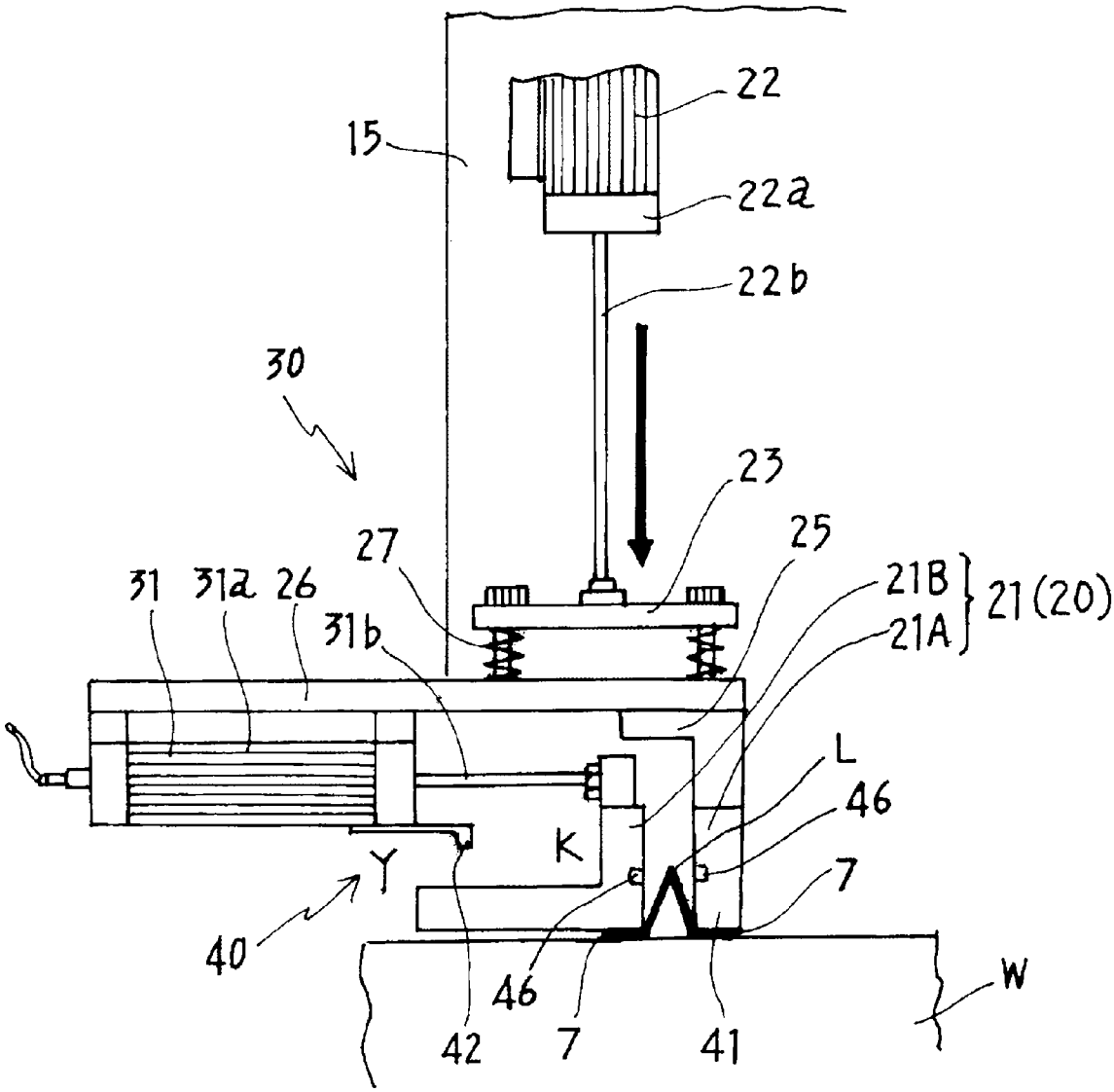
FIG. 5 is a front view showing the operation of the label application device related to the first embodiment of the present invention.
Figure 6:
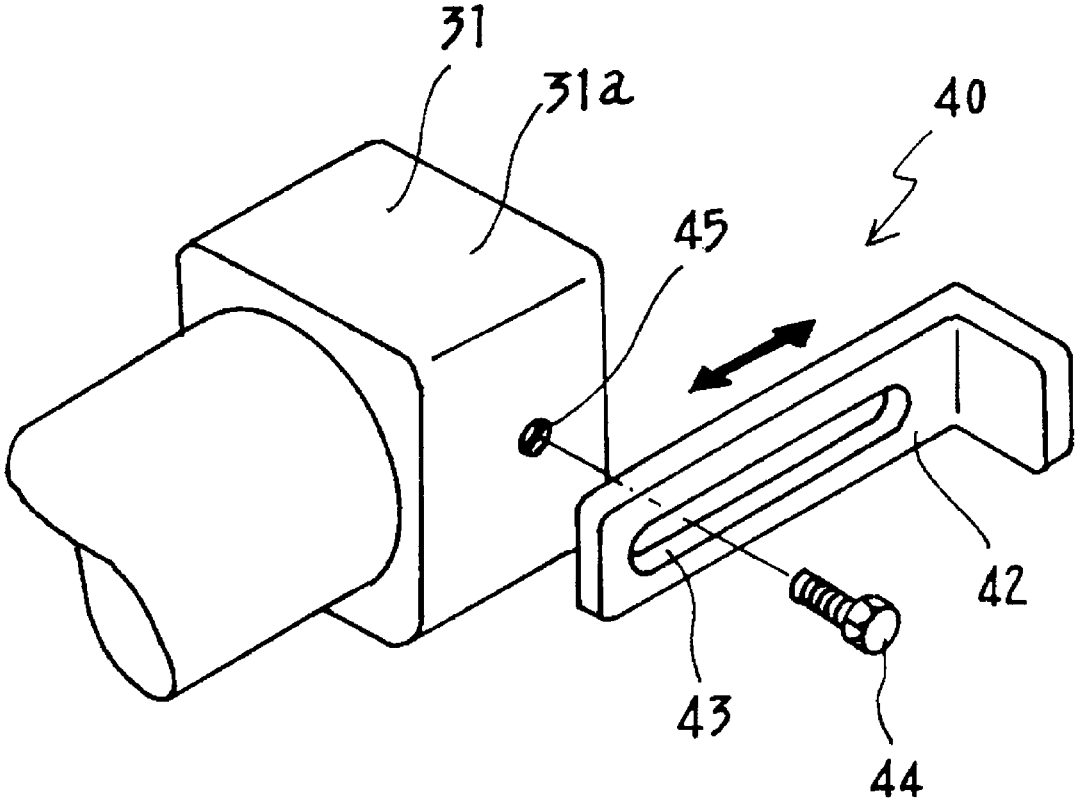
FIG. 6 is an exploded perspective view showing a substantial portion of the label application device related to the first embodiment of the present invention.
Figure 7:
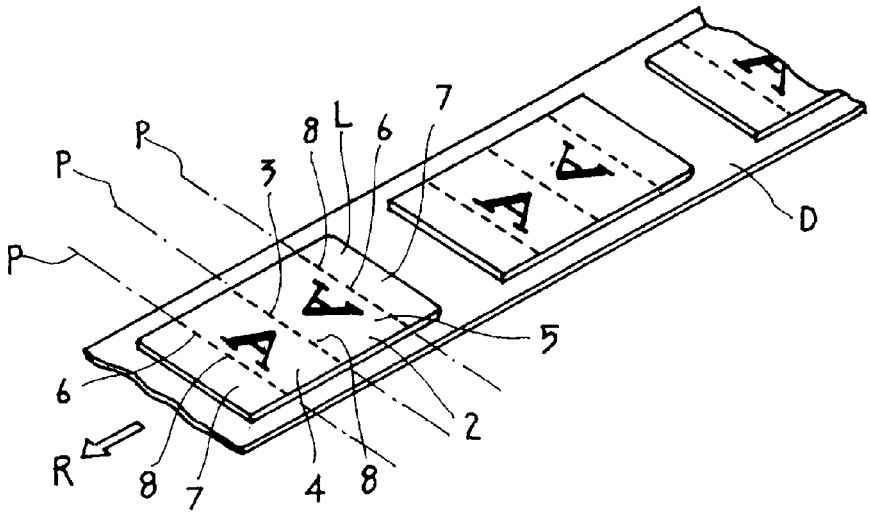
FIG. 7(*a*) is a diagram showing an example of a label used in the label application device related to the first embodiment of the present invention.
Figure 7:
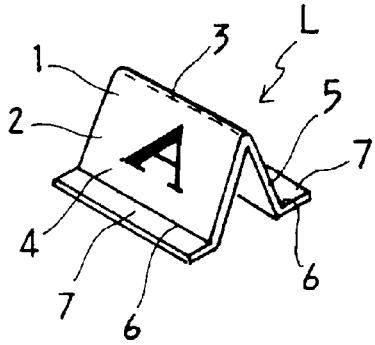
Figure 7:
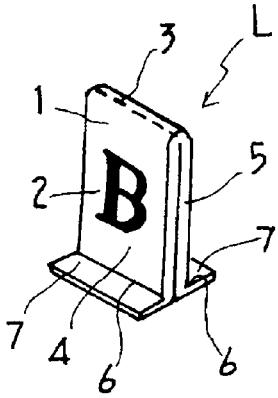
Figure 7:
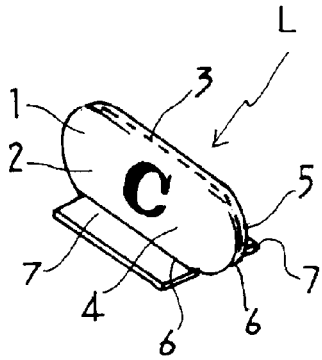

First, FIGS. 1 through 6 show the label application device T1 related to the first embodiment of the present invention. The label L which is the object of the label application device T1 related to the first embodiment, as shown in FIGS. 1, 7(*a*), 7(*b*) and 7(*c*), is a rectangular-shaped label, which is formed as a folded portion 1 with a portion 2 in the middle part of the label folded and protruded from the back side to the surface side in a mountain-shape and having a first side face 4 and a second side face 5 with an apex portion 3 as a border therebetween, and having each outer end portion 7 provided next to each base end portion of the first side face 4 and the second side face 5 of the folded portion 1 via a bent portion 6. Only the back sides of the outer end portions 7, or the entire back side are coated with an adhesive and, in a planar state, are temporally attached to the backing sheet in a row. The label L is temporally attached to the strip-shaped backing sheet D with the folding lines P of the apex portion 3 and the bent portions 6 perpendicular to the longitudinal direction of the strip-shaped backing sheet D (the supplying direction R of the label L).

In addition, the label L which is the object of the label application device T1 related to the first embodiment, is not limited only to the above-mentioned rectangular shape, but as shown in FIG. 7(*d*), a portion 2 in the middle part of the label may be formed in a variant form. In the label L shown in FIG. 7(*d*), the first side face 4 and the second side face 5 are wider in width than the outer end portions 7, and the side edges of the first side face 4 and the second side face 5 are formed in a semi-circular arc shape.

At the folding lines P of the apex portion 3 and the bent portions 6, perforations 8 are formed. As the perforations 8 are formed, folding can be performed easily.

Then the label L, as shown in FIG. 7(*b*), is applied providing a space between the first side face 4 and the second side face 5 of the label L forming the label L as it were in an inverted V-shape, or as shown in FIGS. 7(*c*) and 7(*d*), the label L is applied joining the first side face 4 and the second side face 5 of the label L.

The label application device T1 related to the first embodiment of the present invention, as shown in FIG. 1, applies the label L to the article W conveyed along the predetermined conveyance direction by the conveyor not shown in the diagram.

The label application device T1, as shown in FIGS. 1 through 4, is provided with a label supplying unit 10. The label supplying unit 10 peels off the label L from the strip-shaped backing sheet D where the label L is temporally attached, and feeds out the label L. The label supplying unit 10 peels off the label L, which is supplied from the supply reel 11 to the conveyance route, from the strip-shaped backing sheet D by the peel-off board 12 and by the take-up reel which is not shown in the diagram, takes up the strip-shaped backing sheet D of which the label L is peeled off. The peel-off board 12, by folding back the strip-shaped backing sheet D conveyed through the conveyance route of the backing sheet D, peels off the label L, of which the rigidity is larger than that of the strip-shaped backing sheet D, from the strip-shaped backing sheet D, feeds out and supplies the label L. In the diagram, the reference number 13 is the thermal head for printing on the label L and the reference number 14 as the platen.

In addition, the label application device T1 is provided with a label holding unit 20 attracting and holding the label L supplied from the label supplying unit 10. The label holding unit 20 is provided with an attracting and holding board 21. The attracting and holding board 21 attracts and hold the surface side of the label L peeled off by the peel-off board 12. At the attracting and holding board 21, a plurality of small holes (not shown in the diagram) attracting and holding the surface of the label L by air suction are provided. The attracting and holding board 21 is divided and formed by the line perpendicular to the supplying direction R of the label L, in other words, the line parallel to the folding lines P of the apex portion 3 and the bent portions 6 of the label L, and formed and provided with a pair of divided bodies 21A and 21B attracting and holding the label L.

Furthermore, the label application device T1 is provided with a folding and applying unit 30. The folding and applying unit 30 is provided with an air cylinder unit 22, provided as a transfer unit transferring the attracting and holding board 21 of the label holding unit 20 to the two positions; the attracting and holding position X where the label attracting and holding board 21 of the label holding unit 20 attracting and holding the label L at the after-mentioned joining position S of the divided bodies 21A and 21B, and the application position Y where the label attracting and holding board 21 of the label holding unit 20 applying the attracted and held label L to the article W at the after-mentioned folded portion 1 forming position of the divided bodies 21A and 21B. In other words, by the air cylinder unit 22 comprising of a cylinder 22*a* and a piston 22*b*, the attracting and holding board 21 is transferred to the attracting and holding position X (FIGS. 1 through 4) at which the label L is attracted and held, and to the application position Y (FIG. 5) at which the label L is applied to the article W. The cylinder 22*a* of the air cylinder unit 22 is supported by a machine base 15, and a fixing board 23 supporting the attracting and holding board 21 is assembled at the end of the piston 22*b*.

Still furthermore, near the peel-off board 12, an air blowing pipe 24 assisting attracting and holding of the label L by the attracting and holding board 21 is provided. The air blowing pipe 24 blows the air towards the attracting and holding board 21 side from the back side of the label L peeled off from the peel-off board 12.

Then, the folding and applying unit 30, at the attracting and holding position X of the attracting and holding board 21 of the attracting and holding unit 20, folds and protrudes a portion 2 of a label L held by the label holding unit 20 from the back side of the label towards the surface side in a mountain-shape forming the folded portion 1 having the first side face 4 and the second side face 5 with the apex portion 3 as a border therebetween, and applies each outer end portion 7 provided next to each base end portion of the first side face 4 and the second side face 5 of the folded portion 1 via the bent portion 6 to the article W. The folding and applying unit 30 is comprised of the attracting and holding board 21 having the above-mentioned divided bodies 21A and 21B.

In detail, the first divided body 21A is supported against the base 26 via the supporting member 25. The base 26 is supported by the fixing board 23 via the spring 27, such that it is possible to absorb the biasing force when the attracting and holding board 21, attracting and holding the label L, is pressed against the article W. The second divided body 21B is supported such that it is possible to be moved in the transferring direction Q along the supplying direction R of the label L. And the folding and applying unit 30 is comprising of the air cylinder unit 31 as the folding unit, wherein the divided bodies 21A and 21B are relatively approaching and separating the other and when approaching the other, a portion 2 of the label L is folded by pressing such that the bent portions 6 of the label L at each end surface 28 (FIGS. 3 and 4) opposing each of the divided body 21A and 21B forming the folded portion 1. This air cylinder unit 31 performs approaching and separating of the second divided body 21B to and from the first divided body 21A, and is comprising of the cylinder 31*a* fixed to the base 26 and the piston 31*b*, where the second divided body 21B is assembled. This makes the directions, the supplying direction R of the label L of the label supplying unit 10 and the approaching and separating direction of the divided bodies 21A and 21B the same.

Furthermore, the folding and applying unit 30 is provided with a movement control unit 40 controlling the movement of the divided bodies 21A and 21B of the folding unit. The movement control unit 40 defines the position of the moving second divided body 21B, at the joining position S (FIG. 2) where the divided bodies 21A and 21B abut the other when the label L supplied from the label supplying unit 10 is attracted and held, from the joining position S to the separation position J (FIG. 3) where the divided bodies 21A and 21B separate from the other enabling to fold the label L, and from the separation position J to the folded portion forming position K (FIGS. 4 and 5) where the divided bodies 21A and 21B approach the other forming the folded portion 1.

The separation position J of the divided bodies 21A and 21B is configured to be at a position where the end portion 28*a* of the end surface 28 of the divided bodies 21A and 21B contact the label L corresponding to the bent portions 6 of the label L. The first divided body 21A is prepared with a length corresponding to the length of the outer end portion 7 of the label L, and with the end portion 28*a* of the end surface 28 contacting the label L positioned at the position of the bent portion 6 of the label L supplied from the label supplying unit 10. The second divided body 21B moves as it attracts and holds the label L, and at the separation position J, the end portion 28*a* is positioned to be at the bent portion 6 of the label L. At the separation position J, a space is formed between the first and the second divided bodies 21A and 21B where a portion 2 of the label L protruding from the back side towards the surface side can enter, and the first and the second divided bodies 21A and 21B attracts and holds both outer end portions 7 of the label L supplying direction R.

In case of applying the label L by providing a space between the first side face 4 and the second side face 5 of the label L forming the label as it were in an inverted V-shape, the folded portion forming position K is configured, as shown in FIGS. 1 and 7(*b*), at a position (FIG. 4) separated from the joining position S by a predetermined interval and where the space between the first side face 4 and the second side face 5 of the label L is formed.

Whereas, as shown in FIG. 7(*c*), in case of applying the label L by joining the first side face 4 and the second side face 5 of the label L, the folded portion forming position K is configured at a position same as the joining position S where the first side face 4 and the second side face 5 of the label L are joined.

The movement control unit 40, specifically, controls the stroke of the air cylinder unit 31. At the joining position S, the movement control unit 40 is provided with a positioning member 41 positioning the second divided body 21B by abutting the second divided body 21B to the first divided body 21A. The positioning member 41 is comprised of the first divided body 21A.

In addition, at the separation position J, the movement control unit 40 is provided with an abutting member 42 abutting against the downstream side surface of the second divided body 21B, and positioning this second divided body 21B to be at the bent portion 6 of the label L as mentioned-above. As shown in FIG. 6, on the abutting member 42, a long hole 43 is formed along the movement direction of the piston 31*b* of the air cylinder unit 31. By inserting the bolt 44 through this long hole 43 and screwing-in this bolt 44 to the internal thread 45 provided at the cylinder 31*a*, the abutting member 42 is fixed to the cylinder 31*a*. By making the inserting position of the bolt 44 to the long hole 43 variable, the abutting position of the second divided body 21B to the abutting member 42 is made variable, enabling adjustment of the second divided body 21B stop position.

The movement control unit 40 positions the second divided body 21B at the folded portion forming position K. On the supporting member 25 of the first divided body 21A, provided is a position detection sensor 46, which is an optical sensor such as a thru-beam sensor or a reflective sensor, etc., detecting the second divided body 21B reaching the folded portion forming position K from the separation position J. The movement control unit 40 is provided with a control unit (not shown in the diagram) which stops the air supply to the cylinder 31*a* and stops the second divided body 21B at the folded portion forming position K when the position detection sensor 46 detects the second divided body 21B reaching the folded portion forming position K from the separation position J, specifically, by detecting the apex portion 3 of the label L.

In this case, as shown in FIGS. 1 and 7(*b*), if applying the label L by providing a space between the first side face 4 and the second side face 5 of the label L forming the label as it were in an inverted V-shape, the position detection sensor 46 is provided at an appropriate position such that it is possible to detect the second divided body 21B reaching the separated position from the joining position S by a predetermined interval.

Whereas as shown in FIG. 7(*c*), in case of applying the label L by joining the first side face 4 and the second side face 5 of the label L, the movement control unit 40 controls the position detection sensor 46 not to perform detection.

Furthermore, the folding and applying unit 30 is provided with an air blowing pipe 50 as a fold assisting unit which assists a portion 2 of the label L protruding from the back side towards the surface side to enter between the first divided body 21A and the second divided body 21B. The air blowing pipe 50 blows the air to a portion 2 of the label L from the back side (the adhesive layer side) of the label L, folds a portion 2 of the label L in a mountain-shape towards the surface side by this blowing force, and is fixed to the machine base 15. By the above-mentioned air cylinder unit 31 (folding unit) and the air blowing pipe 50 (fold assisting unit), a portion 2 of the label L is folded, forming the folded portion 1 provided with the first side face 4 and the second side face 5 formed with the apex portion 3 as a border therebetween, with each having the bent portion 6.

Therefore, the application of the label L by the label application device T1 related to the first embodiment will be as follows. Here, as shown in FIGS. 1 and 7(*b*), the label application by providing a space between the first side face 4 and the second side face 5 of the label L forming the label as it were in an inverted V-shape will be explained.

Figure 2:
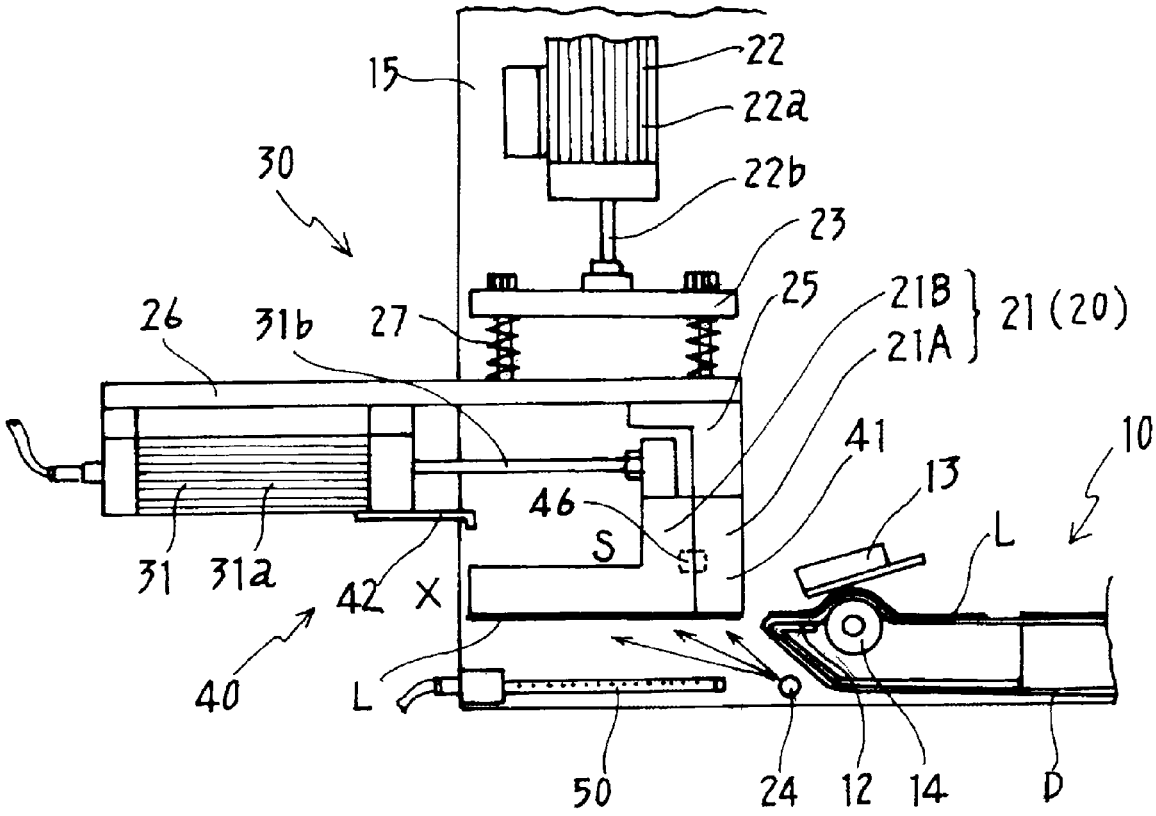
FIG. 2 is a front view showing the operation of the label application device related to the first embodiment of the present invention.

First, as shown in FIG. 2, by the air cylinder unit 31, the second divided body 21B of the attracting and holding board 21 is positioned at the joining position S, and the divided bodies 21A and 21B are abutting the other. Also, by the air cylinder unit 22, this attracting and holding board 21 is positioned at the attracting and holding position X. In this state, when the label L is conveyed by the label supplying unit 10, and the backing sheet D is peeled off by the peel-off board 12, the attracting and holding board 21 attracts and hold the label L at the attracting and holding position X.

Figure 3:
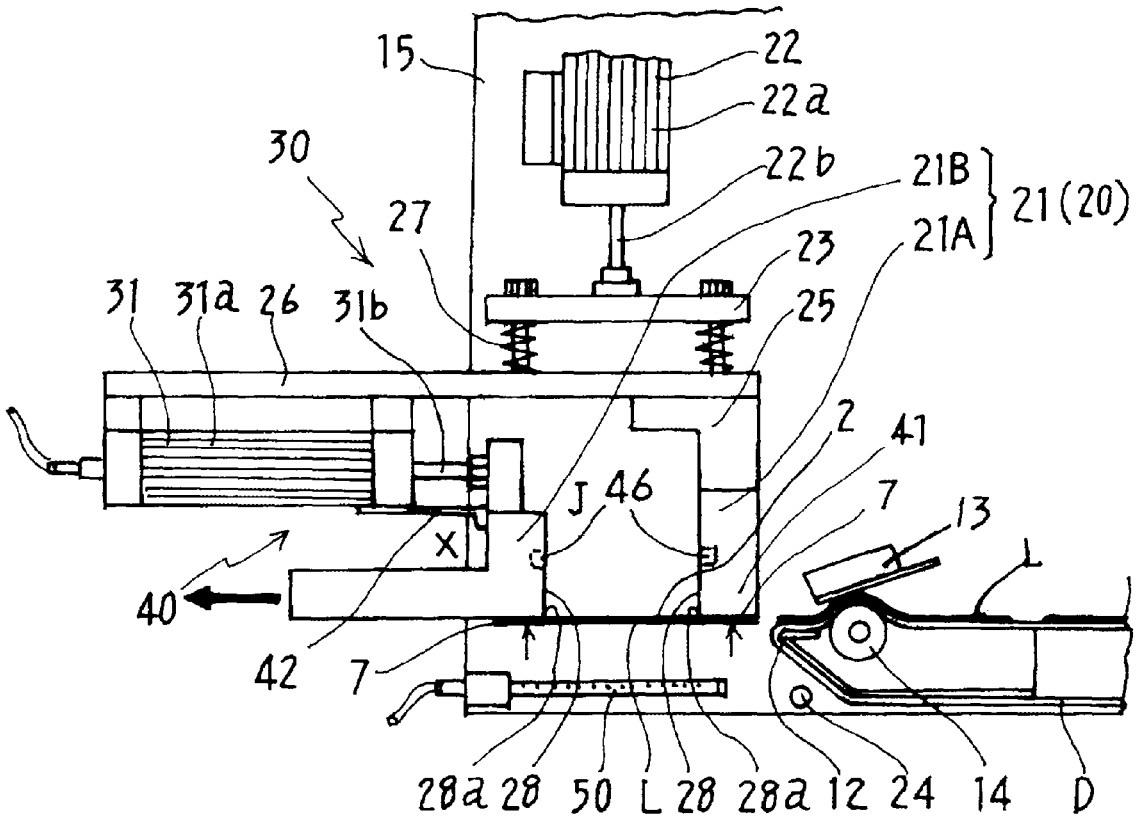
FIG. 3 is a front view showing the operation of the label application device related to the first embodiment of the present invention.

Next, as shown in FIGS. 1 and 3, the air cylinder unit 31 is operated and the second divided body 21B is abutted against the abutting member 42 adjusted to position at the bent portion 6 of the label L and positioned at the separation position J. By this, a space is formed between the first divided body 21A and the second divided body 21B where a portion 2 of the label L protruding from the back side (the adhesive layer side) towards the surface side (the indication layer side) can enter.

Figure 4:
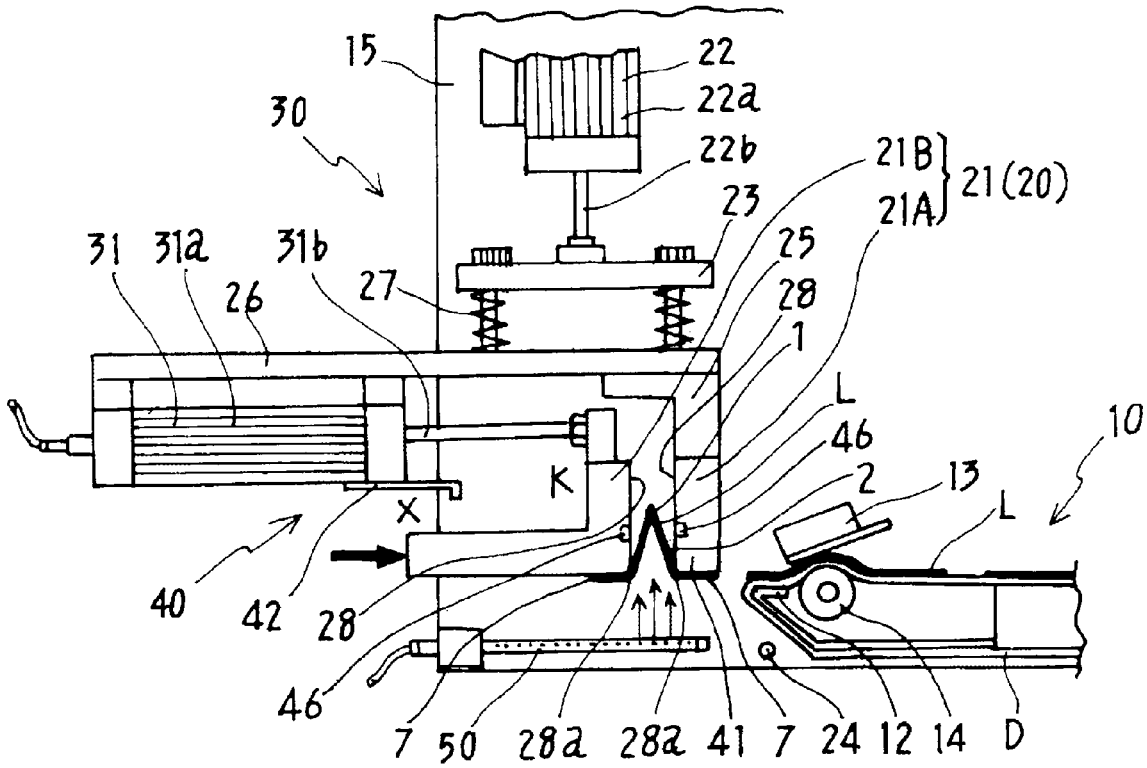
FIG. 4 is a front view showing the operation of the label application device related to the first embodiment of the present invention.

In this state, as shown in FIGS. 1 and 4, the air cylinder unit 31 is operated, and the second divided body is moved from the separation position J to the folded portion forming position K. Also, at this time, the air is blown out from the air blowing pipe 50 towards the back side (the adhesive layer side) of a portion 2 of the label L. Thereby the first divided body 21A and the second divided body 21B each attracts and holds the respective outer end portions 7 at the supplying direction R of the label L, and in the direction of the first side face 4 and the second side face 5 approaching the other, presses the bent portions 6 of the first side face 4 and the second side 5 forming the folded portion 1. In this case, by the air blowing force from the air blowing pipe 50 pressing a portion 2 of the label L towards the surface side (the indication layer side), a portion 2 of the label L is folded in a mountain-shape securely.

Then, as the position detection sensor 46 detects the second divided body 21B reaching the folded portion forming position K from the separation position J, the air supply to the cylinder 31*a* stops, and the second divided body 21B is stopped at the folded portion forming position K.

Then, as shown in FIGS. 1 and 5, the air cylinder unit 22 operates and moves the attracting and holding board 21 from the attracting and holding position X to the application position Y, thereby applying the attracted and held label L to the article W. In this case, both outer end portion 7 of the folded portion 1 at a portion 2 of the label L protruded in a mountain-shape, are pressed to the article W by the first divided body 21A and the second divided body 21B securely applying the label L to the article W. After applying the label L, the attracting and holding board 21 is returned to the attracting and holding position X by the air cylinder unit 22, and the divided body 21B of the attracting and holding board 21 is positioned at the joining position S by the air cylinder unit 31.

Next, regarding the label application device T1 related to the first embodiment, as shown in FIG. 7(*c*), the case of applying the label L by joining the first side face 4 and the second side face 5 will be explained. In this case, the label application device T1 is operated almost in the same way as the above-mentioned, but unlike the above-mentioned, the movement control unit 40 positions the folded portion forming position K at the same position as the joining position S. Therefore, when the attracting and holding board 21 attracts and holds the label L at the attracting and holding position X, and moves the second divided body 21B from the separation position J to the folded portion forming position K, and then the air cylinder unit 31 operates moving the second divided body 21B from the separation position J to the folded portion forming position K, since the folded portion forming position K is at the same position as the joining position S, the second divided body 21B is abutted to the first divided body 21A. Thereby the end surfaces 28 opposing each of the first divided body 21A and the second divided body 21B abut and press the surfaces of the first side face 4 and the second side face 5, which are at a portion 2 of the label L, forming the folded portion 1. The other operations and effects are the same as the above-mentioned.

Figure 8:
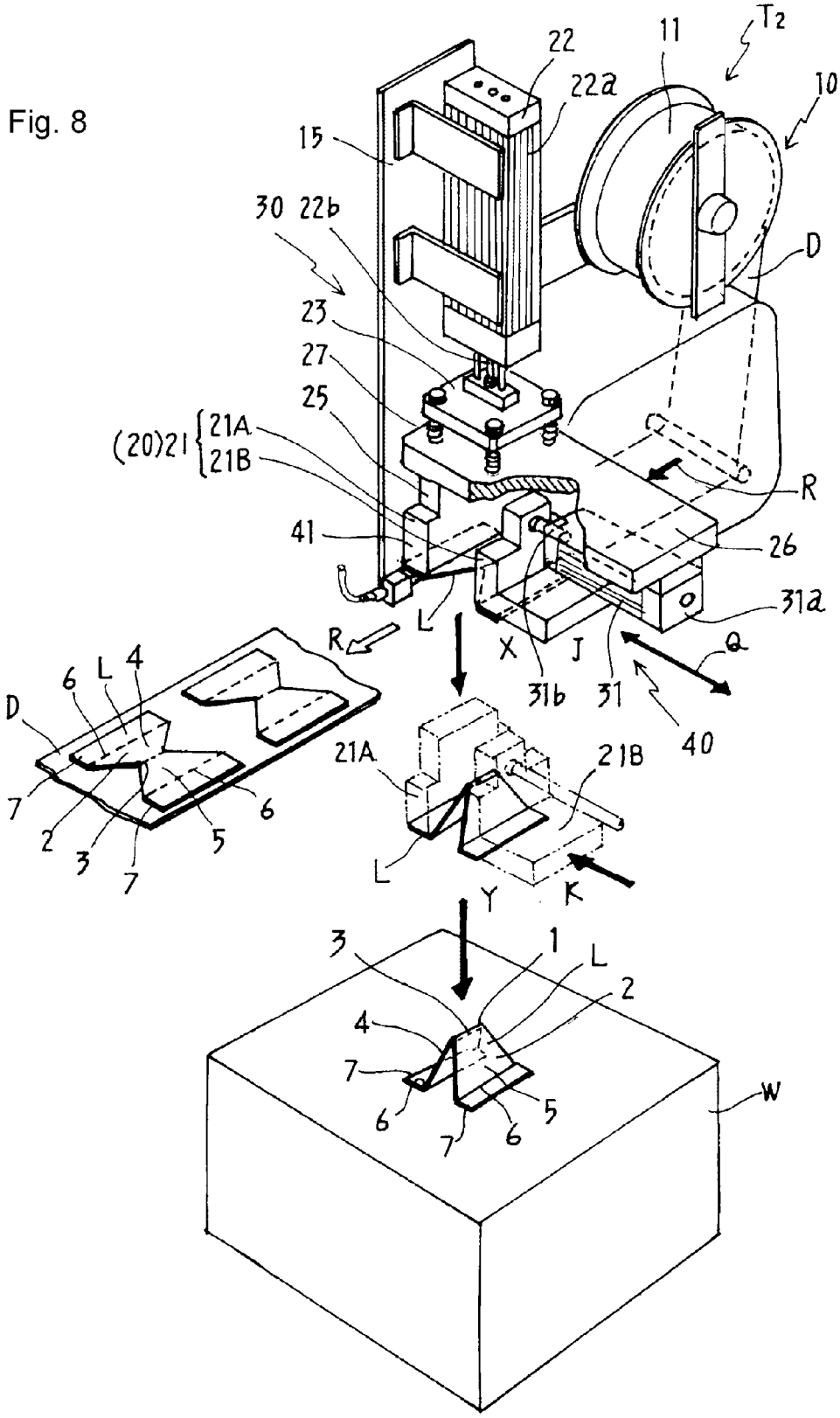
FIG. 8 is a perspective view showing the label application device related to the second embodiment of the present invention.

Next, the label application device T2 related to the second embodiment of the present invention shown in FIGS. 8 through 12 will be explained. The label L which is the object of the label application device T2 related to the second embodiment, as shown in FIGS. 8 and 13, is formed as a folded portion 1 with a portion 2 in the middle part of the label folded and protruded from the back side to the surface side in a mountain-shape and having a first side face 4 and a second side face 5 with an apex portion 3 as a border therebetween, and having each outer end portion 7 provided next to each base end portion of the first side face 4 and the second side face 5 of the folded portion 1 via a bent portion 6. Only the back sides of the outer end portions 7, or the entire back side are coated with adhesive and, in a planar state, are temporally attached to the backing sheet in a row. The label L, unlike the above-mentioned, is temporally attached to the backing sheet D with the folding lines P of the apex portion 3 and the bent portions 6 parallel to the longitudinal direction (the label L supplying direction R) of the backing sheet D.

In addition, the label L which is the object of the label application device T2 related to the second embodiment may be a rectangular shape as is in the above-mentioned, but as shown in FIGS. 8 and 13, the label L, mainly, is a label with the middle portion 2 formed in a variant form with the first side face 4 and the second side face 5 constricted inwardly such that a portion of the label is smaller in width.

At the folding line of the apex portion 3 and the bent portions 6 of the label L, perforations 8 are formed. The presence of the perforations 8 enables folding to be performed easily.

Then, the label L, as shown in FIG. 13(*b*), is applied providing space between the first side face 4 and the second side face 5 of the label L forming the label L as it were in an inverted V-shape, or as shown in FIGS. 7(*c*) and 7(*d*), the label L is applied joining the first side face 4 and the second side face 5 of the label L.

The label application device T2 related to the second embodiment of the present invention is configured almost identical with the above-mentioned first embodiment, but unlike the above-mentioned first embodiment, as shown in FIG. 8, the label supplying direction R of the label supplying unit 10 is perpendicular to the approaching and separating direction Q of the divided bodies 21A and 21B. In addition, as shown in FIGS. 9 through 12, the air blowing pipe 50 as the hold assisting unit is provided at the base machine 15 with the axis line direction rotated 90 degrees from the above-mentioned air blowing pipe 50 related to the first embodiment. The other configuration is almost the same.

Therefore, when applying the label L by the label application device T2 related to the second embodiment, it will be performed as follows. Here, as shown in FIGS. 8 and 13(*b*), the case when the label L is applied providing a space between the first side face 4 and the second side face 5 of the label L forming the label as it were in an inverted V-shape will be explained.

Figure 9:
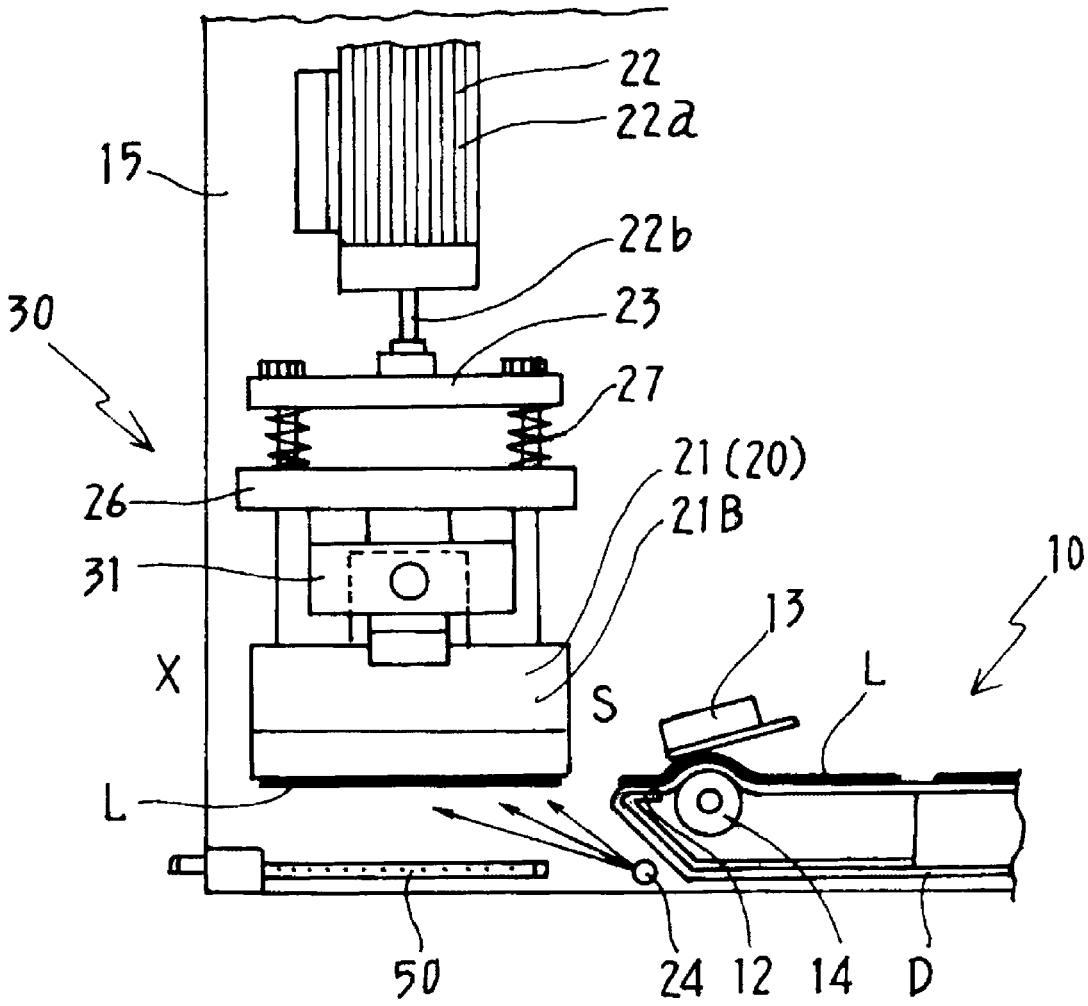
FIG. 9 is a front view showing the operation of the label application device related to the second embodiment of the present invention.

First, as shown in FIG. 9, the second divided body 21B of the attracting and holding board 21 is positioned at the joining position S by the air cylinder unit 31, and the divided bodies 21A and 21B are abutting the other. In addition, by the air cylinder unit 22, the attracting and holding board 21 is positioned at the attracting and holding position X. In this state, as the label L is conveyed by the label supplying unit 10 and the backing sheet D is folded back by the peel-off board 12 peeling off the label L, the attracting and holding board 21 attracts and holds the label L at the attracting and holding position X.

In this case, if the label L, as shown in FIG. 13, is a label with the middle portion 2 formed in a variant form with the first side face 4 and the second side face 5 constricted inwardly such that a portion of the label is smaller in width, the rigidity of the label L is smaller accordingly. However, as the label L is fed out with the apex portion 3 and the folding line P parallel to the longitudinal direction (the supplying direction R of the label L) of the backing sheet D, thereby preventing the label from flexing and curving at supply, enabling the label to be attracted and held securely.

Next, as shown in FIGS. 8 and 19, the air cylinder unit 31 is operated, and the second divided body 21B is abutted against the abutting member 42 adjusted to position at the bent portion 6 of the label L and positioned at the separation position J. This forms a space between the first divided body 21A and the second divided body 21B where a portion 2 of the label L protruding from the back side (the adhesive layer side) to the surface side (the indication layer side) can enter.

Figure 10:
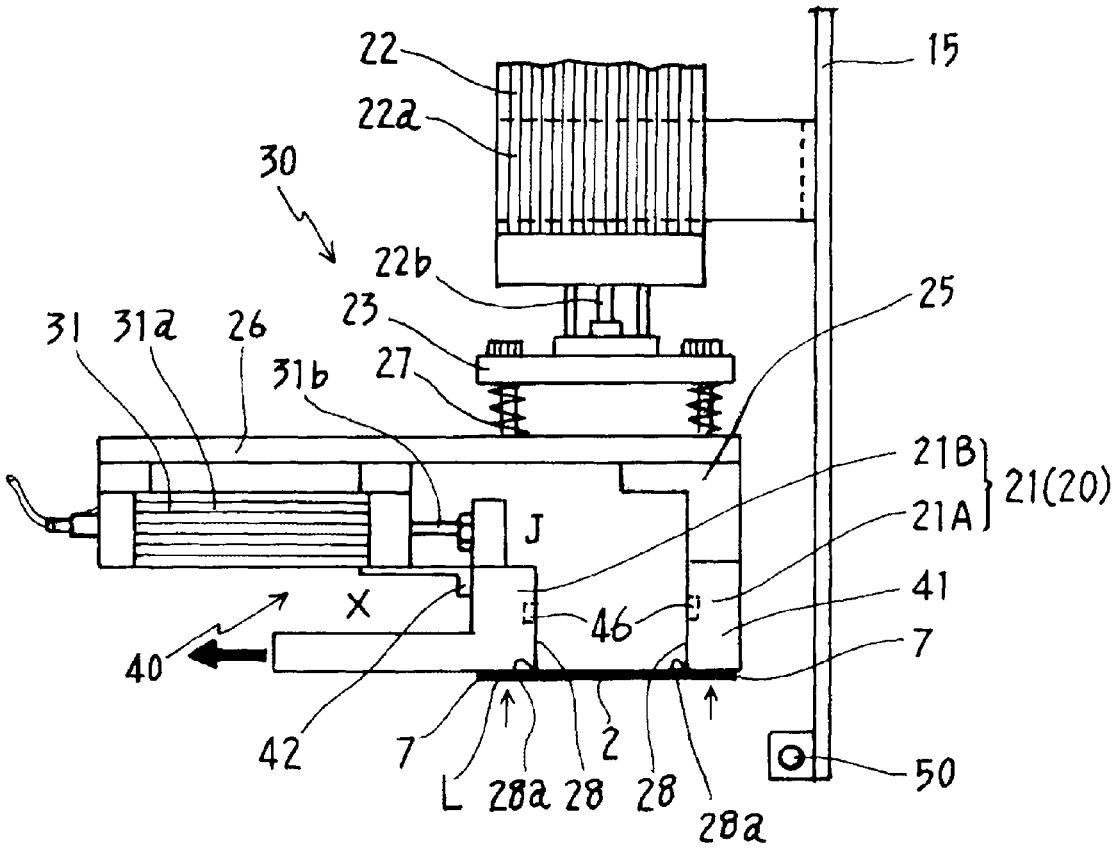
FIG. 10 is a side view showing the operation of the label application device related to the second embodiment of the present invention.
Figure 11:
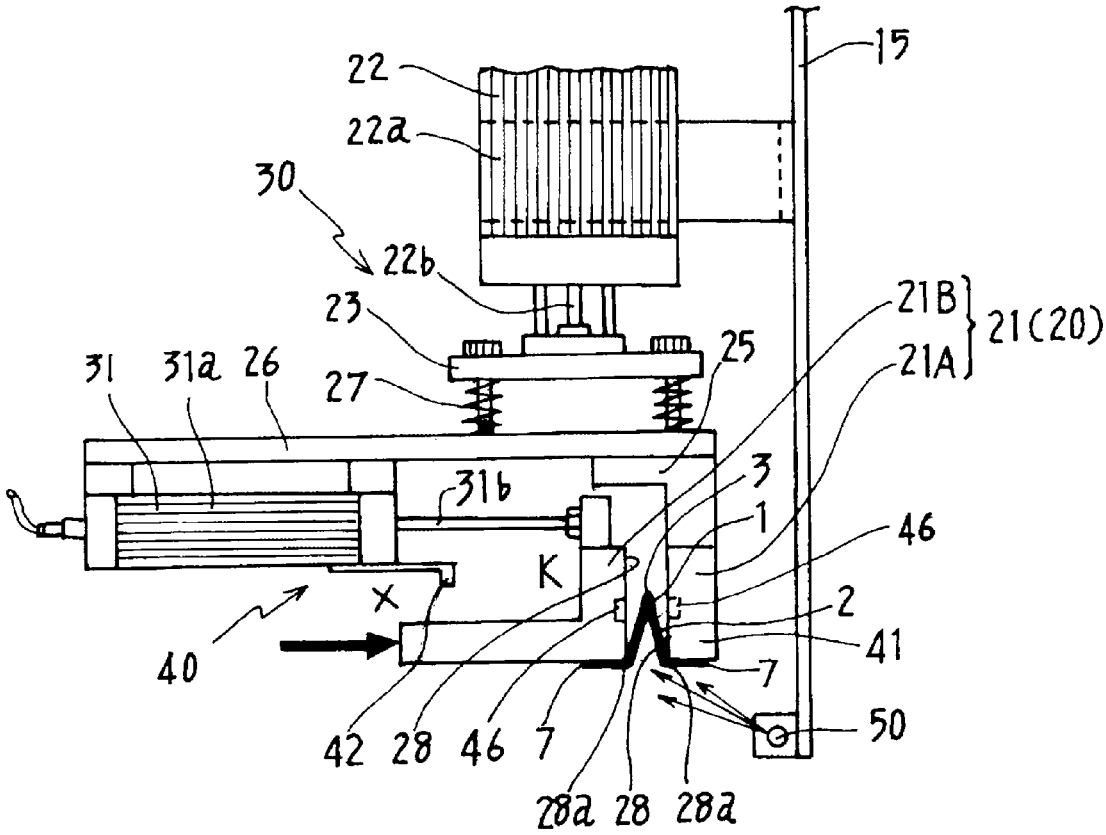
FIG. 11 is a side view showing the operation of the label application device related to the second embodiment of the present invention.

In this state, as shown in FIGS. 8 and 10, the air cylinder unit 31 is operated, and the second divided body is moved from the separation position J to the folded portion forming position K. Also, at this time, the air is blown out from the air blowing pipe 50 towards the back side (the adhesive layer side) of a portion 2 of the label L. Thereby the first divided body 21A and the second divided body 21B each attracts and holds the respective outer end portions 7 at the supplying direction R of the label L, and in the direction of the first side face 4 and the second side face 5 approaching the other, presses the bent portions 6 of the first side face 4 and the second side 5 forming the folded portion 1. In this case, by the air blowing force from the air blowing pipe 50 pressing a portion 2 of the label L towards the surface side (the indication layer side), a portion 2 of the label L is folded in a mountain-shape securely.

Then, as the position detection sensor 46 detects the second divided body 21B reaching the folded portion forming position K from the separation position J, the air supply to the cylinder 31*a* stops, and the second divided body 21B is stopped at the folded portion forming position K.

Figure 12:
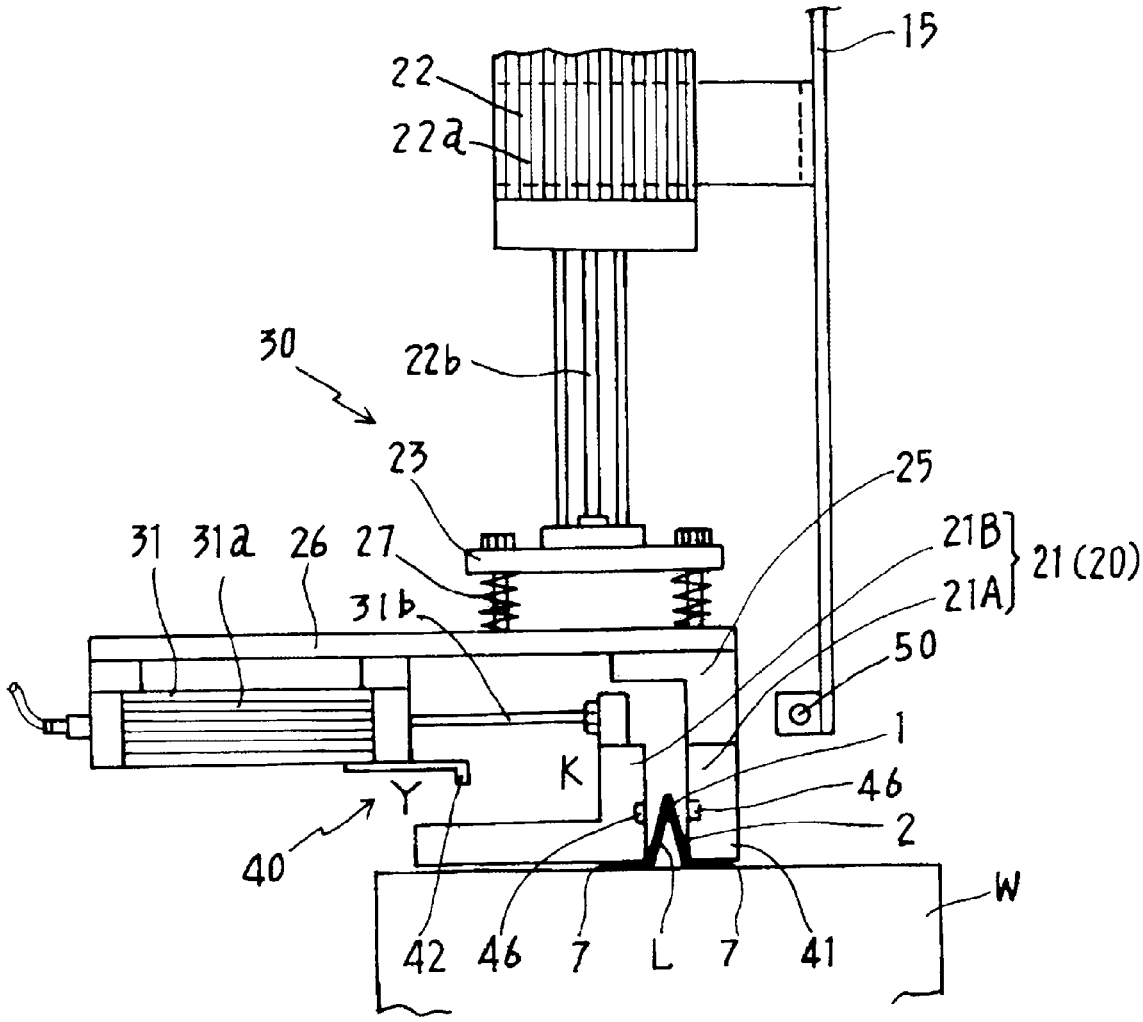
FIG. 12 is a side view showing the operation of the label application device related to the second embodiment of the present invention.
Figure 13:
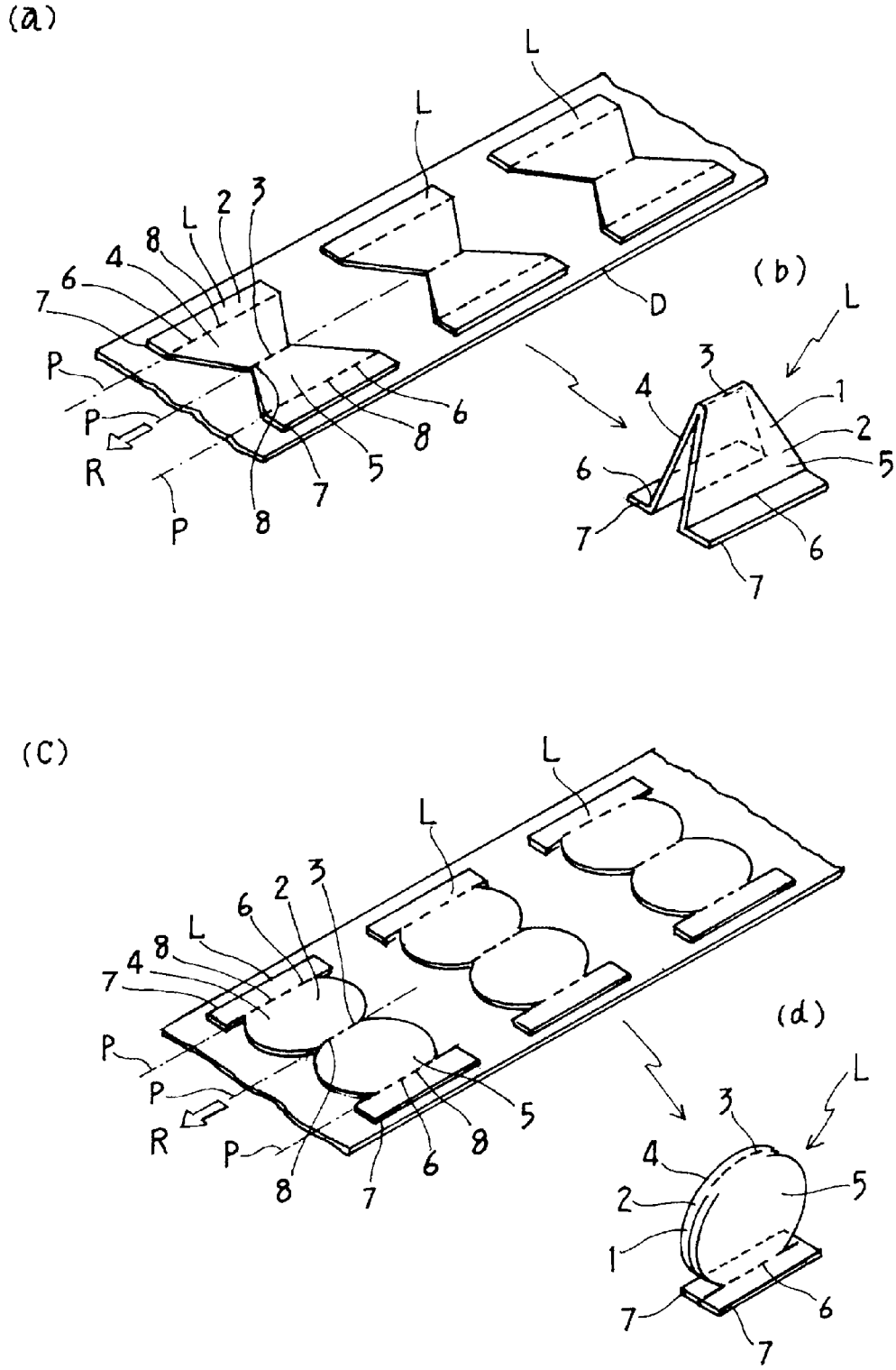
FIG. 13(*a*) is a diagram showing an example of the label used in the label application device related to the second embodiment of the present invention.
Figure 14:
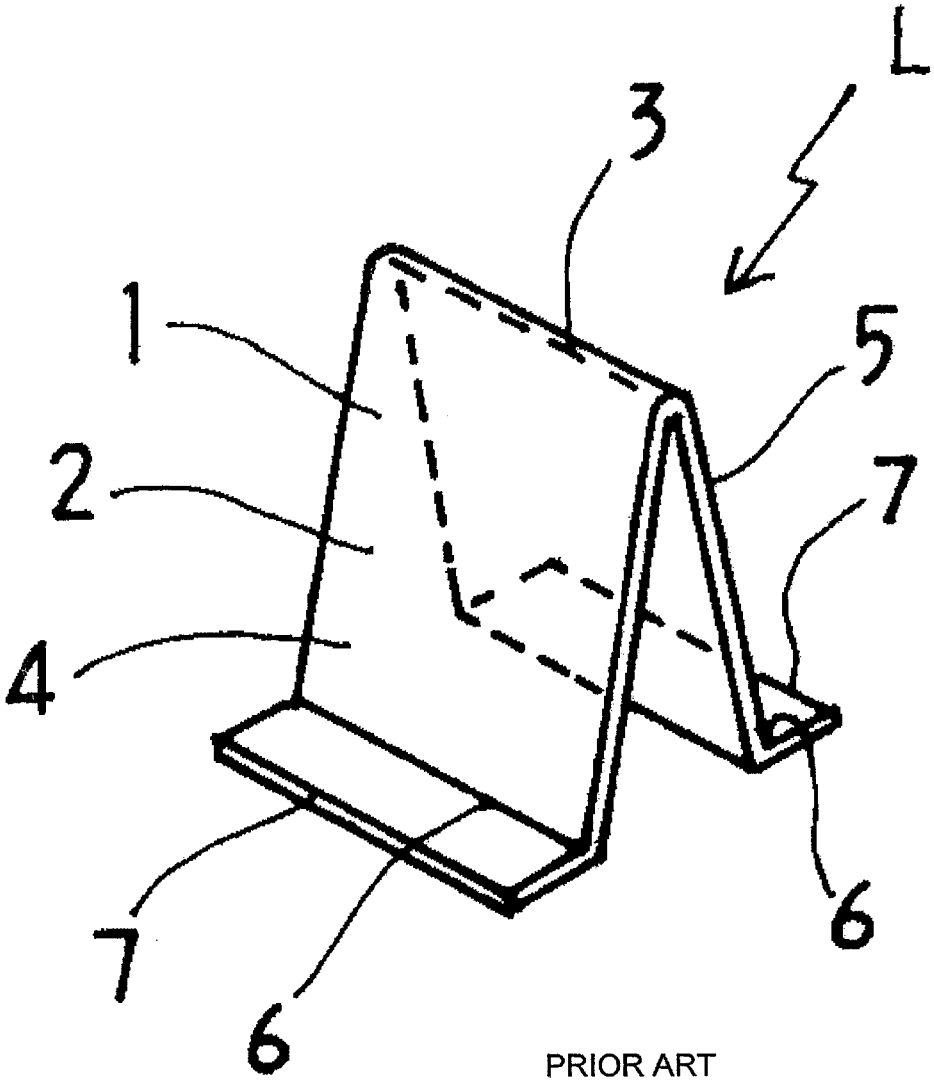
FIG. 14 is a diagram showing an example of the label used in the present invention.

Then, as shown in FIG. 12, the air cylinder unit 22 operates and moves the attracting and holding board 21 from the attracting and holding position X to the application position Y, thereby applying the attracted and held label L to the article W. In this case, both outer end portion 7 of the folded portion 1 at a portion 2 of the label L protruded in a mountain-shape, are pressed to the article W by the first divided body 21A and the second divided body 21B applying the label L to the article W securely. After applying the label L, the attracting and holding board 21 is returned to the attracting and holding position X by the air cylinder unit 22, and the divided body 21B of the attracting and holding board 21 is positioned at the joining position S by the air cylinder unit 31.

Next, regarding the label application device T2 related to the first embodiment, as shown in FIG. 13(*d*), the case of applying the label L by joining the first side face 4 and the second side face 5 is explained. In this case, the label application device T1 is operated almost in the same way as the above-mentioned, but unlike the above-mentioned, the movement control unit 40 positions the folded portion forming position K at the same position as the joining position S. Therefore, when the label L is attracted and held at the attracting and holding position X, and the second divided body 21B is positioned at the separation position J, and then the air cylinder unit 31 is operated moving the second divided body 21B from the separation position J to the folded portion forming position K, the second divided body 21B is abutted to the first divided body 21A, as the folded portion forming position K is at the same position as the joining position S. Thereby the end surfaces 28 opposing each of the first divided body 21A and the second divided body 21B abut and press surfaces of the first side face 4 and the second side face 5, which are at a portion 2 of the label L, forming the folded portion 1. The other operations and effects are the same as the above-mentioned.

In addition, in the above-mentioned embodiments, the fold assisting unit is configured using the air blowing pipe 50 blowing the air to a portion 2 of the label L from the back side. However, it is not limited to the above. For example, an air blowing pipe 24 may be used instead of the air blowing pipe 50, or even a suction nozzle sucking a portion 2 of the label L from the surface side may be used. It can be anything assisting folding a portion 2 of the label L in the same direction.

Also, even if it is a label L provided without the perforations 8 and fold lines, etc., the present invention may be applied. Furthermore, in case the label is provided with perforations 8 or fold lines, etc., such that a portion 2 of the label L may be folded in a mountain-shape easily, it is not necessary to especially provide the fold assisting unit. However, to fold a portion 2 of the label L from the back side towards the surface side securely, it is desirable to provide a fold assisting unit.

Still furthermore, in the label application device of the above-mentioned embodiment, the strokes of the air cylinder unit 31 controlled by the movement control unit 40 of the air cylinder unit 31 is made to mechanically stop the second divided body 21B by the first divided body 21A and the abutting member 42, as the positioning members 41. However, it is not necessarily limited by the disclosure herein, but like the case positioning the second divided body 21B at the folded portion forming portion K, the air cylinder unit 31 may be controlled to stop by position detection using the position detection sensor 46, and appropriate modifications may be made. In addition, not only limited to the position detection sensor 46, but for example, the movement control unit 40 may move the air cylinder unit 31 by time-control, using a timer, etc., monitoring the driving time of the air cylinder unit 31. Furthermore, instead of the air cylinder unit 31, it may be configured, for example, by using an actuator operating the piston 31*b* by the rack and pinion mechanism, or an actuator moving the piston 31*b* by an electric motor, and with appropriate modifications.

Still furthermore, in the above-mentioned embodiments, although it is described that the label application device pressing and applying the label L to the article W by the air cylinder unit 22 moving the attracting and holding board 21 to the application position Y from the attracting and holding position X, it is not only limited to this. It is needless to mention that the present invention may also be applicable to a label application device with a label application method (the air-jet method) applying the label L by blowing the label L towards the article W.

CITATION LIST

Patent Literature 1: Registered Japanese Utility Model Publication No. 3073917

REFERENCE SIGNS LIST

T1 and T2 label application device
L label
W article
1 folded portion
2 a portion
3 apex portion
4 first side face
5 second side face
6 bent portion
7 outer end portion
D strip-shape backing sheet
R supplying direction of label
P folding line of apex portion and bent portion
10 label supplying unit
11 supplying reel
12 peel-off board
20 label holding unit
21 attracting and holding board
21A first divided body
21B second divided body
22 air cylinder unit (transfer unit)
X attracting and holding position
Y applying position
24 air blowing pipe
28 end surface
28*a* end portion

30 folding and applying unit
31 air cylinder unit (folding unit)
Q transferring direction
S joining position
J separation position
K folded portion forming position
40 movement control unit
41 positioning member
42 abutting member
43 long hole
44 bolt
45 internal thread
46 position detection sensor
50 air blowing pipe (folding and applying unit)

What is claimed is:

1. A label application device configured to apply a label supplied from a label supplying unit, the label application device comprising:

a label holding unit configured to attract and hold the label supplied from the label supplying unit; and a folding and applying unit configured to fold and protrude a portion of the label held by the label holding unit from the back side of the label towards the front surface side in a mountain-shape so as to form a folded portion having a first side face and a second side face with an apex portion as a border therebetween, the label including a first outer end portion separated from the first side face by a first bent portion and a second outer end portion separated from the second side face by a second bent portion;

the folding and applying unit configured to apply to an article each outer end portion of the label;

wherein the label holding unit comprises a divided body comprising a pair of members, the divided body configured to attract and hold the label; and the folding and applying unit comprising:

a folding unit, wherein the members of the pair of members are positioned and configured to approach each other and to separate from each other so as to fold the folded portion of the label by pressing the label so as to form the folded portion; and a movement control unit positioned and configured to control the approach and separation of the pair of members of the folding unit, wherein the movement control unit is configured to control the folding and applying unit to define positions of the pair of members with respect to each other, including a folded portion forming position where the members are at a position separated by a predetermined interval from each other so as to form a space between the first side face and the second side face of the label, and the label application device is configured to apply the label to the article when the folding and applying unit is in the folded portion forming position, wherein the movement control unit is configured and positioned to define additional positions of the members of the divided body with respect to each other, the positions including a joining position where the members abut each other so as to hold the label when the label is supplied from the label supplying unit, and a separation position where the members are separated from each other enabling folding of the label before the members are moved to the folded portion forming position where the members approach each other from the separation position for forming the folded portion;

further comprising a position detection sensor configured to detect a position of the label when the pair of members reach the folded portion forming position based on sensing a position of the folded portion of the label, wherein the movement control unit is configured to stop air supply to the label based on the detecting by the position detection sensor.

2. The label application device according to claim 1, wherein the outer end portions of the label lie in a first plane, and a first member of the divided body comprises a first end surface parallel to the first plane, and the second member of the divided body comprise a second end surface parallel to the first plane, such that the first end surface and the second end surface face, respectively, the first outer end and the second outer end of the label, and the separation position of the divided body is the position at which an end portion of the first and second end surfaces of the divided body are in contact with the label in corresponding positions to the first and second bent portions of the label.

3. The label application device according to claim 1, wherein the label application device configures the folded portion forming position at a position separated by a predetermined interval from the joining position so as to form the space between the first side face and the second side face of the label.

4. The label application device according to claim 1, wherein the folding and applying unit includes a fold assisting unit configured to assist a portion of the label to be folded from the back side to the surface side in a mountain-shape.

5. The label application device according to claim 4, wherein the fold assisting unit comprises an air blowing pipe to blow air onto a portion of the label from the back side of the label, and to fold a portion of the label toward the surface side by force of blowing air, the label application device further comprising a second air blowing pipe positioned adjacent a peel-off board of the label supplying unit.

6. The label application device according to claim 1, wherein the movement control unit is configured and positioned to control the approach and separation of the pair of members along a first direction such that the first direction is perpendicular to a label supplying direction of the label supplying unit.

7. The label application device according to claim 1, wherein the folding and applying unit includes a transfer unit configured to transfer the label holding unit between an attracting and holding position where the label holding unit attracts and holds the label and an applying position where the attracted and held label is applied to the article.

* * * * *